US012595648B2

(12) United States Patent
Chen et al.

(10) Patent No.: US 12,595,648 B2
(45) Date of Patent: Apr. 7, 2026

(54) FLUSHING CONTROL METHOD OF INTELLIGENT TOILETS, INTELLIGENT TOILET AND ELECTRONIC DEVICE

(71) Applicant: SHENZHEN MEGMEET ELECTRICAL CO., LTD., Shenzhen (CN)

(72) Inventors: Zhuchun Chen, Shenzhen (CN); Linhui Jing, Shenzhen (CN)

(73) Assignee: SHENZHEN MEGMEET ELECTRICAL CO., LTD., Shenzhen (CN)

( * ) Notice: Subject to any disclaimer, the term of this patent is extended or adjusted under 35 U.S.C. 154(b) by 122 days.

(21) Appl. No.: 18/815,805

(22) Filed: Aug. 26, 2024

(65) Prior Publication Data

US 2025/0237048 A1 Jul. 24, 2025

(30) Foreign Application Priority Data

Jan. 24, 2024 (CN) ..... 202410103183.3

(51) Int. Cl.
*E03D 5/10* (2006.01)

(52) U.S. Cl.
CPC ..... *E03D 5/105* (2013.01)

(58) Field of Classification Search
CPC ..... E03D 5/105; E03D 11/13; E03D 11/18
USPC ..... 4/313, 406, 421–424, 427
See application file for complete search history.

(56) References Cited

U.S. PATENT DOCUMENTS

2013/0104305 A1* 5/2013 Stack ..... E03D 11/13 4/427

FOREIGN PATENT DOCUMENTS

DE 3228061 A1 * 2/1983
JP 03090755 A * 4/1991

* cited by examiner

*Primary Examiner* — Tuan N Nguyen
(74) *Attorney, Agent, or Firm* — BAYES PLLC

(57) ABSTRACT

This embodiments of the present application disclose a flushing control method of intelligent toilets, an intelligent toilet and an electronic device. The intelligent toilet includes a bent pipe, a flushing control mechanism, a siphon detection mechanism, and a microcontroller. In response to a start of the flushing control mechanism, the siphon detection mechanism detects whether a siphon state is formed in the bent pipe. The siphon detection mechanism and the flushing control mechanism are connected to the microcontroller. In response to that the siphon detection mechanism detects a siphon state formed in the bent pipe, the microcontroller controls the flushing control mechanism to stop; wherein, the total operation duration of the flushing control mechanism is shorter than or equal to the default flushing duration of the intelligent toilet.

16 Claims, 5 Drawing Sheets

FLUSHING CONTROL METHOD OF INTELLIGENT TOILETS, INTELLIGENT TOILET AND ELECTRONIC DEVICE

CROSS-REFERENCE TO RELATED APPLICATION

The present application claims the benefit of priority to Chinese Patent Application No. 202410103183.3, filed on Jan. 24, 2024, which is hereby incorporated by reference in its entirety.

TECHNICAL FIELD

The application pertains to the field of intelligent sanitary ware, and in particular to a flushing control method of intelligent toilets, an intelligent toilet and an electronic device.

TECHNICAL BACKGROUND

At present, there are two types of intelligent toilet flushing on the market, i.e., manual flushing and automatic flushing. The automatic flushing is convenient, hygienic, and brings a good user experience. However, its disadvantage is that it cannot determine and distinguish the object to be flushed. To ensure the flushing force, in the automatic flushing mode, the default flushing volume is the maximum flushing volume, resulting in waste of water resources.

SUMMARY

This disclosure provides a flushing control method of intelligent toilets, an intelligent toilet, and an electronic device with the view to improve the water-saving performance of the intelligent toilet.

To achieve the above technical effect, the disclosure provides an intelligent toilet having a bent pipe and a suction pump. The intelligent toilet includes:

a siphon detection mechanism, in response to the start of a flushing control mechanism, detecting whether a siphon state is formed in the bent pipe; and a microcontroller, connected with the siphon detection mechanism and the flushing control mechanism and, in response to the siphon detection mechanism detecting a siphon state formed in the bent pipe, controlling the flushing control mechanism to stop; wherein, a total operation duration of the flushing control mechanism is shorter than or equal to a default flushing duration of the intelligent toilet.

In some embodiments, the siphon detection mechanism acquires a first time when a siphon state is formed in the bent pipe, a difference between the first time and the start time of the flushing control mechanism is a first difference which is positively correlated with a total operation duration of the flushing control mechanism.

In some embodiments, in response to that the first difference is within a first preset threshold, the microcontroller also controls the flushing control mechanism to stop when the siphon detection mechanism detects that the siphon state is formed in the bent pipe for a first duration.

In some embodiments, in response to that the first difference is within a second preset threshold, the microcontroller also controls the flushing control mechanism to stop when the siphon detection mechanism detects that the siphon state is formed in the bent pipe for a second duration; wherein, the second preset threshold is larger than the first preset threshold and the second duration is longer than the first duration.

In some embodiments, in response to that the first difference is within a third preset threshold, the microcontroller also controls the flushing control mechanism to stop when the siphon detection mechanism detects that the siphon state is formed in the bent pipe for a third duration; wherein, the third preset threshold is larger than the second preset threshold and the third duration is longer than the second duration;

In response to that the total operation duration of the flushing control mechanism is longer than or equal to the default flushing duration, the microcontroller also controls the intelligent toilet to flush in accordance with the default flushing duration.

In some embodiments, in response to the siphon detection mechanism not detecting the formation of the siphon state in the bent pipe, the microcontroller also controls the intelligent toilet to flush in accordance with the default flushing duration.

In some embodiments, the siphon detection mechanism includes:

a water level detection assembly, provided in the bent pipe and connected to the microcontroller for detecting a water level in the bent pipe.

In some embodiments, the water level detection assembly comprises at least one of a capacitive water level sensor or an ultrasonic water level sensor.

In some embodiments, the bent pipe includes:

a first pipe section, and a second pipe section, wherein the first pipe section and the second pipe section have a first end proximate to a bottom wall of the intelligent toilet and a second end away from the bottom wall of the intelligent toilet; the first end of the first pipe section is connected to the cavity of the intelligent toilet, the second end of the first pipe section is connected to the second end of the second pipe section, and the first end of the first pipe section is higher than the first end of the second pipe section;

wherein the first pipe section is provided with a water level detection assembly proximate to the second pipe section; or the second pipe section is provided with a water level detection assembly proximate to the first pipe section.

This application also provides a flushing control method of intelligent toilets; the intelligent toilet includes a bent pipe and a flushing control mechanism, and the control method includes the following steps:

in response to a start of the flushing control mechanism, detect whether a siphon state is formed in the bent pipe; and in response to detecting the siphon state formed in the bent pipe, controlling the flushing control mechanism to stop; wherein, a total operation duration of the flushing control mechanism is shorter than or equal to a default flushing duration of the intelligent toilet.

In some embodiments, the step of in response to detecting a siphon state formed in the bent pipe, controlling the flushing control mechanism to stop includes:

acquiring a first time when the siphon state is formed in the bent pipe and a first difference representing a difference between the first time and the start time of the flushing control mechanism, wherein the first difference is positively correlated with a total operation duration of the flushing control mechanism.

In some embodiments, the step of acquiring the first time when the siphon state is formed in the bent pipe and the first difference representing the difference between the first time and the start time of the flushing control mechanism further comprises:

in response to that the first difference is within a first preset threshold and the siphon state formed in the bent pipe reaches a first duration, controlling the flushing control mechanism to stop.

In some embodiments, the step of acquiring the first time when the siphon state is formed in the bent pipe and the first difference representing the difference between the first time and the start time of the flushing control mechanism further includes:

in response to that the first difference is within a second preset threshold and the siphon state formed in the bent pipe reaches a second duration, controlling the flushing control mechanism to stop;

wherein, the second preset threshold is larger than the first preset threshold and the second duration is longer than the first duration.

In some embodiments, the step of acquiring the first time when the siphon state is formed in the bent pipe and the first difference representing the difference between the first time and the start time of the flushing control mechanism also includes:

in response to that the first difference is within a third preset threshold and the siphon state formed in the bent pipe reaches a third duration, controlling the flushing control mechanism to stop; wherein the third preset threshold is larger than the second preset threshold and the third duration is longer than the second duration; or in response to that the third duration is longer than or equal to the default flushing duration, controlling the intelligent toilet to flush in accordance to the default flushing duration.

In some embodiments, the control method also includes:

in response to that no siphon state is detected in the bent pipe, controlling the intelligent toilet to flush in accordance with the default flushing duration.

This disclosure also provides an electronic device which includes:

a memory, storing a flushing control program for the intelligent toilet; and a processor, electrically connected to the memory; when the flushing control program of the intelligent toilet is executed by the processor, the processor executes any flushing control method in above embodiments.

As in the solutions provided above, the flushing control mechanism is controlled to stop when the siphon detection mechanism detects a siphon state formed in the bent pipe, so that the operation duration of the flushing control mechanism is shorter than or equal to the default flushing duration of the intelligent toilet, and thus the water-saving performance of the intelligent toilet is improved by controlling the operation duration of the flushing control mechanism.

BRIEF DESCRIPTION OF DRAWINGS

To provide a clearer explanation of the technical scheme in the embodiments of this application, a brief introduction will be given to the accompanying drawings required in the description of the embodiments. Obviously, the accompanying drawings in the following description are only some embodiments of the application. The persons skilled in the art can obtain other drawings based on these drawings without putting in creative labor.

Figure 1:
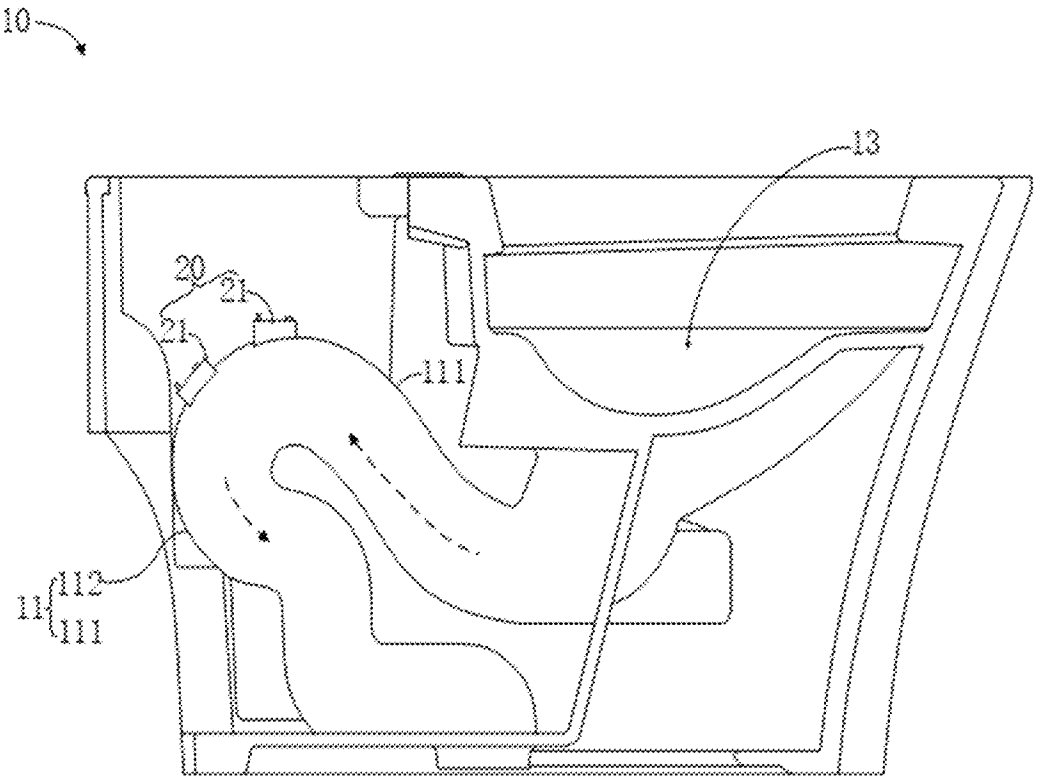
FIG. 1 illustrates a schematic structural diagram of an intelligent toilet, according to some embodiments.

10—intelligent toilet; 11—bent pipe; 111—first pipe section; 112—second pipe section; 12—flushing control mechanism; 13—cavity; 20—siphon detection mechanism; 21—water level detection assembly; 30—microcontroller; 40—memory; 50—processor.

DETAILED DESCRIPTION

The following provides a clear description of the technical solutions of the embodiments in this disclosure, with reference to the drawings. Obviously, the described embodiments are only a portion of, not all embodiments in this disclosure. Based on the embodiments in this disclosure, all other embodiments that can be obtained by a person skilled in the art without creative labor are within the protection scope of this disclosure.

In the description of this disclosure, it should be understood that the terms "center", "longitudinal", "transverse", "length", "width", "thickness", "top", "front", "back", "left", "right", "vertical", "horizontal", "top", "bottom", "inside", "outside" and the like indicating orientations or positional relationships based on those shown in the drawings are intended only to facilitate and simplify the description of this disclosure, but are not intended to indicate or imply that the device or component must be in a specific direction, or be constructed and operated in a specific direction. Therefore, these terms cannot be understood as a limitation to the disclosure. In addition, the terms "first" and "second" are only used to describe the purpose and cannot be understood as indicating or implying relative importance or implicitly specifying the number of technical features instead. Therefore, the "first" and "second" features can explicitly or implicitly include one or more features. In the description of this disclosure, the term "a plurality of" means two or more, unless otherwise specified.

In this disclosure, the term "exemplary" indicates "an example, illustration, or description." Any embodiment described as "exemplary" in this disclosure can not necessarily be interpreted as more preferred or advantageous than other embodiments. In order to enable any person skilled in the art to implement and use this disclosure, the following description is provided. In the following description, details are listed for explanatory purposes. It should be understood that ordinary persons skilled in the art can recognize that this disclosure can also be implemented without using these specific details. In other embodiments, the detailed description of publicly known structure and process will not be provided to avoid unnecessary details that can obscure the description of this disclosure. Therefore, this disclosure is not intended to be limited to the embodiments mentioned herein, but is consistent with the widest scope of principles and features disclosed herein.

The word "a plurality of" in embodiments in this disclosure refers to at least two (including two).

The intelligent toilet is a common sanitary ware product. After years of development and improvement, the current intelligent toilets have a plurality of user-friendly functions, greatly facilitating people's life. Intelligent toilets often include a cavity, a bent pipe and a suction pump. The bent pipe is connected to the cavity. Wherein, the suction pump can pump water to the cavity and the bent pipe; when the water level inside the bent pipe rises to a preset height, a siphon state can be formed in the bent pipe, and the feculence can be discharged under the action of siphon. The bent pipe in some embodiments in this disclosure may be an S-shaped bent pipe. In some embodiments, the intelligent toilets have two flushing modes. The water flow rate in the small flushing mode for urine is lower than that in the large flushing mode for excrement. However, a user needs to select the corresponding flushing mode. In the automatic flushing mode, the default is the large flushing mode, and the water flow rates for excrement and urine are the same, resulting in waste of water.

Figure 2:
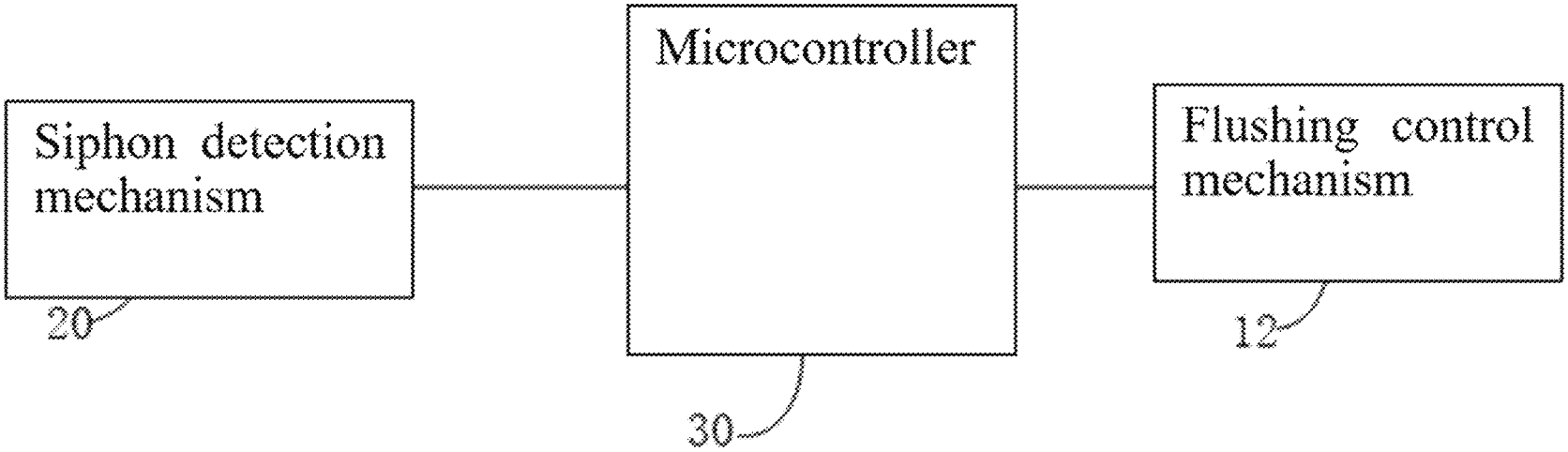
FIG. 2 illustrates a block diagram of a control system of the intelligent toilet, according to some embodiments.

In an embodiment, referring to FIG. 1 and FIG. 2, an intelligent toilet 10 has a bent pipe 11 and a flushing control mechanism 12. The intelligent toilet 10 further includes a siphon detection mechanism 20 and a microcontroller 30. In response to the start of the flushing control mechanism 12, the siphon detection mechanism 20 detects whether a siphon state is formed in the bent pipe 11. The siphon detection mechanism 20 and the flushing control mechanism 12 are connected to the microcontroller 30. In response to the siphon detection mechanism 20 detecting the siphon state formed in the bent pipe 11, the microcontroller 30 controls the flushing control mechanism 12 to stop operating; wherein, the total operation duration of the flushing control mechanism 12 is shorter than the default flushing duration of the intelligent toilet 10.

In this embodiment, the flushing control mechanism 12 may be a suction pump. In some embodiments, the flushing control mechanism 12 may also be a valve assembly. The flushing control mechanism 12 can pump water to a cavity 13. When water in the cavity 13 reaches a preset level, the siphon state can be formed in the bent pipe 11, and at this time, the bent pipe 11 is full of water.

The microcontroller 30, which may be an integrated circuit and connected to the electric signal of the flushing control mechanism 12, controls the operation of the flushing control mechanism 12. In this embodiment, when the flushing control mechanism 12 is started, the flushing control mechanism 12 pumps water to the cavity 13. When water in the cavity 13 reaches the preset level and the siphon state is formed in the bent pipe 11, the bent pipe 11 is filled with water. The siphon detection mechanism 20 detects the siphon state formed in the bent pipe 11. The microcontroller, upon receiving a siphon signal and its time characteristic, delays the control of stopping the flushing control mechanism 12 from operating. During the operation of the flushing control mechanism 12, feculence in the bent pipe 11 is discharged out of the intelligent toilet 10 under the siphon action.

The intelligent toilet 10 is provided with a default flushing duration. In this embodiment, the default flushing duration may be a preset duration for the automatic flushing. The default flushing duration may be an operation duration of the flushing control mechanism 12 preset when the intelligent toilet 10 leaves the factory. For example, the default flushing duration may be set to 8.8 seconds for the operation of the flushing control mechanism 12. In this embodiment, the preset operation duration of the flushing control mechanism 12 may include a total duration from the start to the stop of the flushing control mechanism 12. Taking the suction pump (flushing control mechanism 12) as an example, after the flushing control mechanism 12 starts, the rotation speed of the motor of the suction pump increases gradually. When the suction pump reaches a preset rotation speed, the amount of water pumped into cavity 13 by the suction pump reaches a preset water amount, so that the siphon state is formed in the bent pipe 11. When the microcontroller sends an electric signal to the suction pump to control the suction pump to stop, the rotation speed of the motor of the suction pump slows down. The total operation duration of the suction pump includes the period from start to stop of the motor of the suction pump.

When the intelligent toilet 10 flushes, the flushing control mechanism 12 starts to operate, and the siphon detection mechanism 20 detects whether the siphon state is formed in the bent pipe 11. When the siphon detection mechanism 20 detects the siphon state formed in the bent pipe 11, under the siphon action, the feculence in the bent pipe 11 is discharged out of the intelligent toilet 10. In this embodiment, the microcontroller 30 is electrically connected to the siphon detection mechanism 20. When the siphon detection mechanism 20 detects the siphon state formed in the bent pipe 11, the microcontroller 30 can send an electric signal to the flushing control mechanism 12 to trigger the flushing control mechanism 12 to cease operation. The total operation duration of the flushing control mechanism 12 is shorter than the default flushing duration of the intelligent toilet 10, which means that the total time from start to stop of the flushing control mechanism 12 whin the flushing cycle is less than the default flushing duration of the intelligent toilet 10.

Due to the fact that the flushing duration of existing toilets is usually corresponding to the default maximum flushing force. In this embodiment, after detecting the siphon state formed in the bent pipe 11, the microcontroller 30 controls the flushing control mechanism 12 to stop so as to control the actual operation duration of the flushing control mechanism 12 to be shorter than the default flushing duration of the intelligent toilet 10. Therefore, the amount of water delivered to the bent pipe 11 by the flushing control mechanism 12 is reduced, improving the water-saving performance of the intelligent toilet 10. In this embodiment, the microcontroller 30 can control the operation of the flushing control mechanism 12. When the siphon detection mechanism 20 detects the siphon state formed in the bent pipe 11, the microcontroller 30 can control the operation of the flushing control mechanism 12. This allows the intelligent toilet 10 to automatically control the operation duration of the flushing control mechanism 12, thereby reducing the waste of water resource. In this embodiment, the flushing control mechanism 12 may be automatically activated when a user leaves the toilet.

In some embodiments, the siphon detection mechanism 20 acquires a first time when the siphon state is formed in the bent pipe 11, a difference between the first time and the start time of the flushing control mechanism 12 is a first difference which is positively correlated with the total operation duration of the flushing control mechanism 12.

The siphon detection mechanism 20 can detect whether the siphon state is formed in the bent pipe 11. When the siphon state is formed in the bent pipe 11, the siphon detection mechanism 20 acquires the time when the siphon state is formed in the bent pipe 11. The time is regarded as the first time.

When the flushing control mechanism 12 starts, the siphon detection mechanism 20 detects the bent pipe 11 to acquire whether the siphon state is formed in the bent pipe 11. When the siphon state is formed in the bent pipe 11, record the time as the first time. Because it takes some time for the flushing control mechanism 12 to reach the siphon state in the bent pipe 11 after being activated, the difference between the first time and the start time of the flushing control mechanism 12 is the first difference which is greater than zero.

When there are solid substances in the bent pipe 11, the fewer and/or softer the feculence, the faster the siphon is formed in the bent pipe 11 after the flushing control mechanism 12 is activated. That is, the first difference between the first time and the start time of the flushing control mechanism 12 is smaller. Conversely, when there is more solid waste or the clumping of solid substances is larger, it becomes more difficult to form a siphon state in the bent pipe 11, and the speed of forming a siphon state in the bent pipe 11 is slower. This means the first difference between the first time and the start time of the flushing control mechanism 12 is larger. When there is urine in the intelligent toilet 10, the formation of the siphon state in the bent pipe 11 is earlier than that of excrement, resulting in different discharge duration for urine and excrement. Due to quick formation of the siphon state, the discharge can be faster.

In this embodiment, the total operation duration of the flushing control mechanism 12 is positively correlated with the first difference, i.e. the smaller the first difference between the first time when the siphon state is formed in the bent pipe 11 and the start time of the flushing control mechanism 12 is, the shorter the total operation duration of the flushing control mechanism 12 is. In this embodiment, when the first difference between the first time when the siphon state is formed in the bent pipe 11 and the start time of the flushing control mechanism 12 is smaller, it means that the time when the siphon state is formed in the bent pipe 11 is earlier, and the discharge duration required by the intelligent toilet 10 is shorter. In this embodiment, the total operation duration of the flushing control mechanism 12 under the control of the microcontroller 30 is positively correlated with the first difference, so the total operation duration of the flushing control mechanism 12 is shorter and less water is pumped to the bent pipe 11 by the flushing control mechanism 12. Therefore, the volume of pumped water of the intelligent toilet 10 corresponds to the time for forming the siphon state in the bent pipe 11, so as to reduce the waste of water resource caused by the maximum flushing volume being the default flushing volume of the intelligent toilet 10. When the siphon state is formed in the bent pipe 11, the feculence in the bent pipe 11 can be discharged out. For different types of feculence, the first time of forming the siphon state is different. When the first difference between the first time and the start time of the flushing control mechanism 12 is smaller, it means that the feculence in the bent pipe 11 is less and/or softer, and it is easier to discharge the feculence in the siphon state. In the corresponding state, the total operation duration of the flushing control mechanism 12 under the control of the microcontroller 30 is shorter. Because when the feculence in the bent pipe 11 is less and/or softer, the water required for discharging feculence out of the intelligent toilet 10 is less. In this embodiment, the microcontroller 30 controls the intelligent toilet 10 to shorten the corresponding discharge duration. Therefore, the discharge duration of the intelligent toilet 10 is matched with the type of feculence so as to reduce the waste of water resources caused by the maximum flushing volume as the default flushing volume.

In this embodiment, the microcontroller 30 may be an independent chip or may be integrated into the master control boards of the intelligent toilet 10, the siphon detection mechanism 20 or a control board of the flushing control mechanism 12. In some embodiments, the control boards of the flushing control mechanism 12, the microcontroller 30 and the siphon detection mechanism 20 may be integrated into the same circuit board.

In some embodiments, the rotation speed of the flushing control mechanism 12 at the first time may be the maximum rotation speed of the flushing control mechanism 12. In this embodiment, since the first time, the siphon state is present in the bent pipe 11. Since the less and/or softer the feculence in the bent pipe 11, the time for forming a siphon state in the bent pipe 11 is earlier, the first difference is smaller, the water volume for discharging feculence out of the bent pipe 11 is less, and the operation duration of the flushing control mechanism 12 is shorter.

In some embodiments, in response to that the first difference is within the first preset threshold, the microcontroller 30 also controls the flushing control mechanism 12 to stop when the siphon detection mechanism 20 detects that the siphon state in the bent pipe 11 reaches a first duration.

The first preset threshold may be a preset range. For example, in this embodiment, the first preset threshold may be less than 3 seconds. In this embodiment, the first duration is greater than zero. The microcontroller 30 or the siphon detection mechanism 20 may be provided with a timer to acquire the first duration when the siphon detection mechanism 20 detects the siphon state in the bent pipe 11. In this embodiment, the first duration may be a preset duration. When the duration of forming a siphon state in the bent pipe 11 reaches the first duration, the microcontroller 30 controls the flushing control mechanism 12 to stop, i.e. after the siphon state is formed in the bent pipe 11, the flushing control mechanism 12 stops operation after delaying the first duration so as to ensure that the flushing control mechanism 12 stops within the preset time.

In this embodiment, through the step that the siphon detection mechanism detects that the siphon state in the bent pipe 11 reaches the first duration, control the flushing control mechanism 12 to stop. The siphon state can be held in the bent pipe 11 within the first duration to discharge feculence out of the bent pipe 11, realizing the full discharge by the intelligent toilet 10.

Taking the suction pump as flushing control mechanism 12 as an example, in this embodiment, in the step of the flushing control mechanism 12 executing the stop operation, the microcontroller 30 sends a trigger signal to the suction pump. The motor of the suction pump is powered off and the rotation speed of the motor of the suction pump decreases. Because the rotation speed of the suction pump reduces, the volume of water conveyed to the cavity is less, resulting in no siphon state in the bent pipe.

In some embodiments, in response to that the first difference is within a second preset threshold, the microcontroller also controls the flushing control mechanism 12 to stop when the siphon detection mechanism 20 detects that the siphon state in the bent pipe 11 reaches a second duration; wherein, the second preset threshold is larger than the first preset threshold and the second duration is longer than the first duration.

The second preset threshold may be a preset range. For example, in this embodiment, the second preset threshold may be 3 seconds to 5 seconds. In this embodiment, the second duration is greater than zero. The second duration may be a preset time. When the duration for forming a siphon state in the bent pipe 11 reaches the second duration, the microcontroller 30 controls the flushing control mechanism 12 to stop, i.e. after the siphon state is formed in the bent pipe 11, the flushing control mechanism 12 stops operation after delaying the second duration so as to ensure that the flushing control mechanism 12 stops within the preset time.

In this embodiment, the second preset threshold is larger than the first preset threshold. Because the first difference can be used to show the duration of forming the siphon state in the bent pipe 11, the earlier the formation of the siphon state in the bent pipe 11, the smaller the first difference is and the shorter the total discharging duration of the intelligent toilet 10 is. In this embodiment, the time when the siphon state is formed in the bent pipe 11 can be confirmed by acquiring the first difference to be within the first preset threshold or the second preset threshold. When the first difference is within the first preset threshold, it can be determined that the first time when the siphon state is formed in the bent pipe 11 is relatively early. When the first difference is within the second preset threshold, it can be determined that the first time when the siphon state is formed in the bent pipe 11 is relatively late. Determine the operation duration of the flushing control mechanism 12 based on the time when the siphon state is formed in the bent pipe 11. Make the second duration longer than the first duration to ensure that the duration of holding the siphon state in the bent pipe 11 is longer. The operation duration of the flushing control mechanism 12 can be controlled for different types of feculence in the bent pipe 11.

In some embodiments, in response to that the first difference is within a third preset threshold, the microcontroller 30 also controls the flushing control mechanism 12 to stop when the siphon detection mechanism 20 detects that the siphon state in the bent pipe 11 reaches a third duration; wherein, the third preset threshold is larger than the second preset threshold and the third duration is longer than the second duration. In response to that the total operation duration of the flushing control mechanism 12 is longer than or equal to a default flushing duration, the microcontroller 30 also controls the intelligent toilet 10 to flush for the default flushing duration.

The third preset threshold may be a preset range. For example, the third preset threshold may be longer than 5 seconds. Because when the feculence is more and harder, the first time when a siphon state is formed in the bent pipe 11 is longer, and the first difference is greater. In this embodiment, the fist time when the siphon state is formed in the bent pipe 11 is relatively later, and the corresponding third duration is longer than the second duration and the first duration in above embodiments.

When the total operation duration of the flushing control mechanism 12 is longer than or equal to the default flushing duration, the microcontroller 30 controls the flushing control mechanism 12 to operate for the default flushing duration so as to ensure that the actual operation duration of the flushing control mechanism 12 is not longer than the default flushing duration. In this embodiment, by controlling the actual total operation duration of the flushing control mechanism 12 shorter than or equal to the default flushing duration. After detecting the siphon state formed in the bent pipe 11, the flushing control mechanism 12 controls based on the first time when the siphon state is formed in the bent pipe 11 so as to ensure that the operation duration of the flushing control mechanism 12 is within the default flushing duration. The shorter the operation duration of the flushing control mechanism 12 is, the less the used water volume is. The waste of water resource is reduced by controlling operation duration of the flushing control mechanism 12.

In some embodiments, in response to the siphon detection mechanism 20 not detecting the formation of the siphon state in the bent pipe 11, the microcontroller 30 also controls the intelligent toilet 10 to flush for the default flushing duration. In this embodiment, the siphon detection mechanism 20 can detect the siphon state in the bent pipe 11, when the siphon detection mechanism 20 detects no siphon state formed in the bent pipe 11, it indicates that the bent pipe 11 may be blocked, resulting in failure of formation of a siphon state in the bent pipe 11 and failure of normal discharge. The microcontroller 30 controls the intelligent toilet 10 to flush for the default flushing duration, ensuring that the intelligent toilet 10 can maintain a maximum flushing force and increase the water volume in the bent pipe 11, which could facilitate the formation of the siphon state in the bent pipe 11 to discharge the feculence under the siphon action.

In some embodiments, the siphon detection mechanism 20 includes a water level detection assembly 21 which is provided in the bent pipe 11. The water level detection assembly 21 is connected to the microcontroller 30 to detect a water level in the bent pipe 11. In this embodiment, the water level detection assembly 21 is used for detecting the water level in the bent pipe 11. When the bent pipe 11 is full of water, the siphon state can be formed in the bent pipe 11. In some embodiments, the water level detection assembly 21 may be a capacitive water level sensor which detects the water level by the principle of electrostatic capacitance induction. In some embodiments, the water level detection assembly 21 may also be an ultrasonic water level sensor to detect the water level. In some embodiments, the number of water level detection assemblies 21 may be two or more. A plurality of water level detection assemblies 21 may be separately spaced apart on the bent pipe 11, and the installation positions of the plurality of water level detection assemblies 21 may be set as needed. In some embodiments, at least one water level detection assembly 21 shall be set on the external pipe wall at or near the highest point of the water level in the bent pipe 11. When the water level reaches the highest point in the bent pipe 11, the siphon state can be formed. In some embodiments, a plurality of water level detection assemblies 21 may be respectively set at the highest point on the internal wall of the bent pipe 11 and at its rear end.

In some embodiments, the bent pipe 11 includes a first pipe section 111 and a second pipe section 112. Both the first pipe section 111 and the second pipe section 112 include the first end proximate to a bottom wall of the intelligent toilet 10 and the second end away from the bottom wall of the intelligent toilet 10; the first end of the first pipe section 111 is connected to the cavity 13 of the intelligent toilet 10, the second end of the first pipe section 111 is connected to the second end of the second pipe section 112, and the first end of the first pipe section 111 is higher than the first end of the second pipe section 112; the first pipe section 111 is provided with a water level detection assembly 21 proximate to the second pipe section 112.

The first pipe section 111 and the second pipe section 112 are connected to each other. The first pipe section 111 is connected to the cavity 13. When the flushing control mechanism 12 operates, water flows through the first pipe section 111 and the second pipe section 112 and is transmitted to outside of the intelligent toilet 10. The first pipe section 111 has a first end and a second end which are set oppositely. The first end of the first pipe section 111 is connected to the cavity 13 of the intelligent toilet 10. The second end of the first pipe section 111 is connected to the second pipe section 112. In this embodiment, the distance between the first end of the first pipe section 111 and the bottom wall of the intelligent toilet 10 is less than the distance between the second end of the first pipe section 111 and the bottom wall of the intelligent toilet 10, i.e. the second end of the first pipe section 111 is higher than the first end of the first pipe section 111. When water flows into the first pipe section 111, the water flow is in an upward state.

The second pipe section 112 has a first end and a second end which are set oppositely. Wherein, the distance between the first end of the second pipe section 112 and the bottom wall of the intelligent toilet 10 is less than the distance between the second end of the second pipe section 112 and the bottom wall of the intelligent toilet 10, i.e. the first end of the second pipe section 112 is lower than the second end of the second pipe section 112. The second end of the second pipe section 112 is connected to the second end of the first pipe section 111. When water flows through the first pipe section 111 into the second pipe section 112, the water flow is in a downward state.

In this embodiment, the first pipe section 111 is provided with the water level detection assembly 21 to detect the water level in the first pipe section 111. In this embodiment, the water level detection assembly 21 may be set on the inner wall of the first pipe section 111 to detect the water level in the first pipe section 111. In some embodiments, the water level detection assembly 21 may be provided through the first pipe section 111. The water level detection assembly 21 is provided proximate to the second pipe section 112, which refers to that the water level detection assembly 21 is provided on the first pipe section 111 proximate to the second pipe section 112. In this embodiment, the water level detection assembly 21 may be set on the second end of the first pipe section 111 or may be set in an area on the first pipe section 111 proximate to the second end. In some embodiments, a plurality of water level detection assemblies 21 may be set on the first pipe section 111, and the plurality of water level detection assemblies 21 may be set in an area of the first pipe section 111 proximate to the second pipe section 112.

In some embodiments, different from above embodiment, the second pipe section 112 is provided with the water level detection assembly 21 proximate to the first pipe section 111. In this embodiment, the second pipe section 112 is provided with the water level detection assembly 21 to detect the water level in the second pipe section 112. In this embodiment, the water level detection assembly 21 may be set on the inner wall of the second pipe section 112 to detect the water level in the second pipe section 112. In some embodiments, the water level detection assembly 21 may be provided through the second pipe section 112. The water level detection assembly 21 is provided proximate to the first pipe section 111, which refers to that the water level detection assembly 21 is provided on the second pipe section 112 and proximate to the first pipe section 111. In this embodiment, the water level detection assembly 21 may be set on the second end of the second pipe section 112 or may be set in an area on the second pipe section 112 proximate to the second end. In some embodiments, a plurality of water level detection assemblies 21 may be set on the second pipe section 112, and the plurality of water level detection assemblies 21 may be set in an area of the second pipe section 112 proximate to the first pipe section 111.

In some embodiments, the number of the water level detection assemblies 21 is two or more. The first pipe section 111 is provided with the water level detection assembly 21 proximate to the second pipe section 112. The second pipe section 112 is provided with the water level detection assembly 21 proximate to the first pipe section 111. In this embodiment, among the plurality of water level detection assemblies 21, some water level detection assemblies 21 are provided on the first pipe section 111 in areas proximate to the second pipe section 112 and some water level detection assemblies 21 are provided on the second pipe section 112 in areas proximate to the first pipe section 111.

Figure 3:
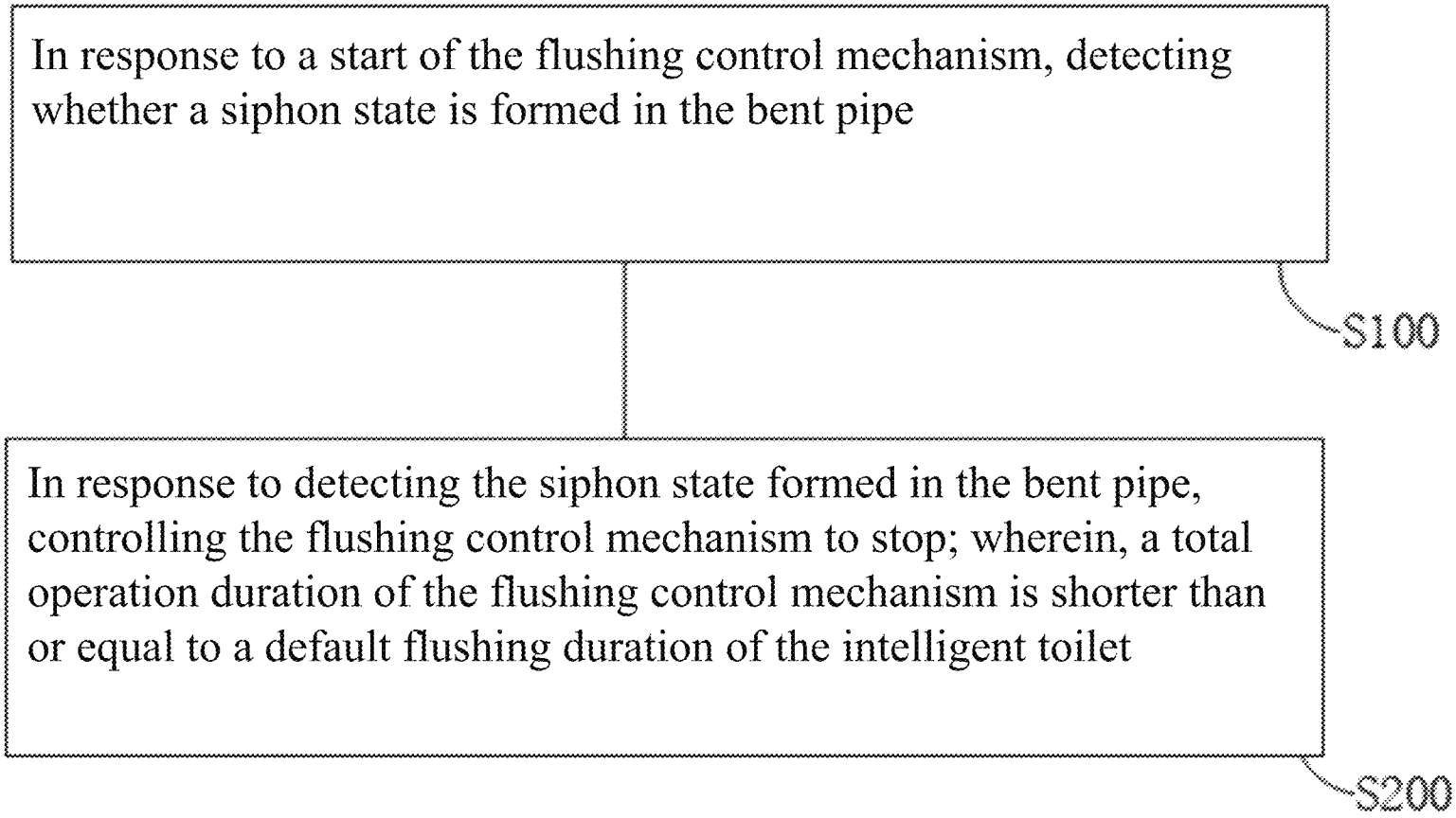
FIG. 3 illustrates a flow chart of a flushing control method of the intelligent toilet, according to some embodiments.

In an embodiment, referring to FIG. 2 and FIG. 3, a flushing control method of the intelligent toilet 10 is provided. The intelligent toilet 10 has a bent pipe 11 and a flushing control mechanism 12. The flushing control mechanism 12 pumps water to a cavity 13 which is connected to the bent pipe 11. When water in the cavity 13 reaches the preset water volume, a siphon state can be formed in the bent pipe 11 and the feculence in the bent pipe 11 can be discharged under the siphon action. In some embodiments, the bent pipe 11 may be S-shaped bent pipe 11. When the bent pipe 11 is full of water, the siphon state can be formed in the bent pipe 11.

Referring to FIG. 3, the control method includes the following steps:

S100: in response to a start of the flushing control mechanism 12, detect whether a siphon state is formed in the bent pipe 11;

When the flushing control mechanism 12 starts, the water level detection assembly 21 and the siphon detection mechanism 20 can detect the bent pipe 11 to determine whether a siphon state is formed in the bent pipe 11.

S200: in response to detecting a siphon state formed in the bent pipe 11, control the flushing control mechanism 12 to stop; wherein, a total operation duration of the flushing control mechanism 12 is shorter than a default flushing duration of the intelligent toilet 10.

In this embodiment, the microcontroller 30 controls the operation of the flushing control mechanism 12. In this embodiment, when the flushing control mechanism 12 starts, the flushing control mechanism 12 pumps water to the cavity 13. When the water in the cavity 13 reaches the preset water volume and a siphon state is formed in the bent pipe 11, the siphon detection mechanism 20 detects that a siphon state is formed in the bent pipe 11. After delay, the microcontroller controls the flushing control mechanism 12 to stop. During operation of the flushing control mechanism 12, feculence in the bent pipe 11 is discharged out of the intelligent toilet 10 under the siphon action.

The intelligent toilet 10 is provided with a default flushing duration. In this embodiment, the default flushing duration can be a preset automatic flushing duration. In this embodiment, the default flushing duration can be a preset duration of the flushing control mechanism 12 when the intelligent toilet 10 leaves factory. For example, the default flushing duration may be set to 8.8 seconds for the operation of the flushing control mechanism 12.

When the intelligent toilet 10 starts flushing, the flushing control mechanism 12 starts operation, and the siphon detection mechanism 20 detects whether the siphon state is formed in the bent pipe 11. When the siphon detection mechanism 20 detects the siphon state formed in the bent pipe 11, feculence in the bent pipe 11 is discharged out of the intelligent toilet 10 under the siphon action. In this embodiment, the microcontroller 30 is connected to the electric signal of the siphon detection mechanism 20. When the siphon detection mechanism 20 detects the siphon state formed in the bent pipe 11, the microcontroller 30 can send an electric signal to the flushing control mechanism 12 to trigger the stop of the flushing control mechanism 12. The total operation duration of the flushing control mechanism 12 is shorter than the default flushing duration of the intelligent toilet 10, which means that the total time from start to stop of the flushing control mechanism 12 within this flushing cycle is less than the default flushing duration of the intelligent toilet 10.

Due to the fact that the flushing duration of existing toilets is usually corresponding to the default maximum flushing force. In this embodiment, after detecting the siphon state formed in the bent pipe 11, the microcontroller 30 controls the flushing control mechanism 12 to stop, so as to control the actual operation duration of the flushing control mechanism 12 to be shorter than the default flushing duration of the intelligent toilet 10. Therefore, the actual flushing duration of the intelligent toilet 10 is shorter than default flushing duration, the amount of water delivered to the bent pipe 11 by the flushing control mechanism 12 is reduced, improving the water-saving performance of the intelligent toilet 10. In this embodiment, the microcontroller 30 can control the operation of the flushing control mechanism 12. When the siphon detection mechanism 20 detects the siphon state formed in the bent pipe 11, the microcontroller 30 can control the operation of the flushing control mechanism 12. This allows the intelligent toilet 10 to automatically control the operation duration of the flushing control mechanism 12, thereby reducing the waste of water resource.

In some embodiments, in step S200, acquiring a first time when the siphon state is formed in the bent pipe 11 and a difference between the first time and the start time of the flushing control mechanism 12. The first difference which is positively correlated with a total operation duration of the flushing control mechanism 12.

The siphon detection mechanism 20 can detect whether the siphon state is formed in the bent pipe 11. When the siphon state is formed in the bent pipe 11, the siphon detection mechanism 20 acquires the time when a siphon state is formed in the bent pipe 11. The time is regarded as the first time.

When the flushing control mechanism 12 starts, the siphon detection mechanism 20 detects the bent pipe 11 to acquire whether the siphon state is formed in the bent pipe 11. Record the time when a siphon state is formed in the bent pipe 11 as the first time. Because there is a certain period from the start of the flushing control mechanism 12 to the time when a siphon state is formed in the bent pipe 11, the difference between the first time and the start time of the flushing control mechanism 12 is the first difference, which is greater than zero.

When there is a solid object in the bent pipe 11, the fewer and/or softer the feculence is, the faster the siphon state is formed in the bent pipe 11 after start of the flushing control mechanism 12, i.e. the first difference between the first time and the start time of the flushing control mechanism 12 is smaller. When there is more solid waste or the clumping of solid substances is larger, it becomes more difficult to form a siphon state in the bent pipe 11, and the speed of forming a siphon state in the bent pipe 11 is slower, i.e. the first difference between the first time and the start time of the flushing control mechanism 12 is larger. When there is urine in the intelligent toilet 10, the formation of the siphon state in the bent pipe 11 is earlier than that of excrement, resulting in different discharge duration for urine and excrement is different. Due to quick formation of the siphon state, the discharge can be faster.

In this embodiment, the total operation duration of the flushing control mechanism 12 is positively correlated with the first difference, i.e. the smaller the first difference between the first time when the siphon state is formed in the bent pipe 11 and the start time of the flushing control mechanism 12 is, the shorter the total operation duration of the flushing control mechanism 12 is. In this embodiment, when the first difference between the first time when the siphon state is formed in the bent pipe 11 and the start time of the flushing control mechanism 12 is smaller, it means that the time when the siphon state is formed in the bent pipe 11 is earlier, and the discharge duration required by the intelligent toilet 10 is shorter. In this embodiment, the total operation duration of the flushing control mechanism 12 under the control of the microcontroller 30 is positively correlated with the first difference, so the total operation duration of the flushing control mechanism 12 is shorter and less water is pumped to the bent pipe 11 by the flushing control mechanism 12. The water volume in the bent pipe 11 is less. The volume of pumped water of the intelligent toilet 10 corresponds to the time for forming a siphon state in the bent pipe 11, so as to reduce the waste of water resource caused by the maximum flushing volume as the default flushing volume of the intelligent toilet 10.

In some embodiments, in step S200, in response to that the first difference is within a first preset threshold and the siphon state in the bent pipe 11 reaches the first duration, control the flushing control mechanism 12 to stop.

The first preset threshold may be less than 3 seconds. In this embodiment, the first duration is greater than zero, and the first duration may be a preset time. When the duration of forming a siphon state in the bent pipe 11 reaches the first duration, control the flushing control mechanism 12 to stop, i.e. after the siphon state is formed in the bent pipe 11, the flushing control mechanism 12 stops operation after delaying the first duration so as to ensure that the flushing control mechanism 12 stops.

In this embodiment, when the duration of forming a siphon state in the bent pipe 11 reaches the first duration, control the flushing control mechanism 12 to stop. The siphon state can be held in the bent pipe 11 within the first duration so as to discharge the feculence out of the bent pipe 11, which can ensure full discharge of the intelligent toilet 10.

In some embodiments, in step S200, in response to that the first difference is within a second preset threshold and the siphon state in the bent pipe 11 reaches a second duration, control the flushing control mechanism 12 to stop; wherein, the second preset threshold is larger than the first preset threshold and the second duration is longer than the first duration.

The second preset threshold may be 3 seconds to 5 seconds. In this embodiment, the second duration is greater than zero. The second duration may be a preset time. When the duration for forming a siphon state in the bent pipe 11 reaches the second duration, control the flushing control mechanism 12 to stop, i.e. after the siphon state is formed in the bent pipe 11, the flushing control mechanism 12 stops operation after delaying the second duration so as to ensure that the flushing control mechanism 12 stops.

In this embodiment, the second preset threshold is larger than the first preset threshold. Because the first difference can be used to show the duration of forming a siphon state in the bent pipe 11, when it is earlier to form the siphon state in the bent pipe 11, the first difference is smaller and the total discharging duration of the intelligent toilet 10 is shorter. In this embodiment, the time when the siphon state is formed in the bent pipe 11 can be confirmed by acquiring the first difference to be within the first preset threshold or the second preset threshold. When the first difference is within the first preset threshold, it can be determined that the first time when the siphon state is formed in the bent pipe 11 is relatively early. When the first difference is within the second preset threshold, it can be determined that the first time when the siphon state is formed in the bent pipe 11 is relatively late. Determine the operation duration of the flushing control mechanism 12 based on the time when the siphon state is formed in the bent pipe 11. Make the second duration longer than the first duration. The duration of holding the siphon state in the bent pipe 11 is longer. The operation duration of the flushing control mechanism 12 can be controlled for different types of feculence in the bent pipe 11.

In some embodiments, in step S200, in response to that the first difference is within the third preset threshold and the siphon state in the bent pipe 11 reaches the third duration, control the flushing control mechanism 12 to stop; wherein, the third preset threshold is larger than the second preset threshold and the third duration is longer than the second duration; in response to that the total operation duration of the flushing control mechanism 12 is longer than or equal to the default flushing duration, control the intelligent toilet 10 to flush for the default flushing duration.

The third preset threshold may be the preset range. For example, the third preset threshold may be longer than 5 seconds. Because when the feculence is more and harder, the first time when the siphon state is formed in the bent pipe 11 is longer, and the first difference is greater. In this embodiment, the first time when the siphon state is formed in the bent pipe 11 is later, and the third duration is longer than the second duration and the first duration in above embodiments.

When the total operation duration of the flushing control mechanism 12 is longer than or equal to the default flushing duration, control the flushing control mechanism 12 to operate for the default flushing duration so as to ensure that the actual operation duration of the flushing control mechanism 12 is not longer than the default flushing duration. In this embodiment, by controlling that the actual total operation duration of the flushing control mechanism 12 is shorter than or equal to the default flushing duration. After detecting the siphon state formed in the bent pipe 11, the flushing control mechanism 12 controls based on the first time when the siphon state is formed in the bent pipe 11 so as to ensure that the operation duration of the flushing control mechanism 12 is within the default flushing duration. The shorter the operation duration of the flushing control mechanism 12 is, the less the used water volume is. The waste of water resource is reduced by controlling operation duration of the flushing control mechanism 12.

Figure 4:
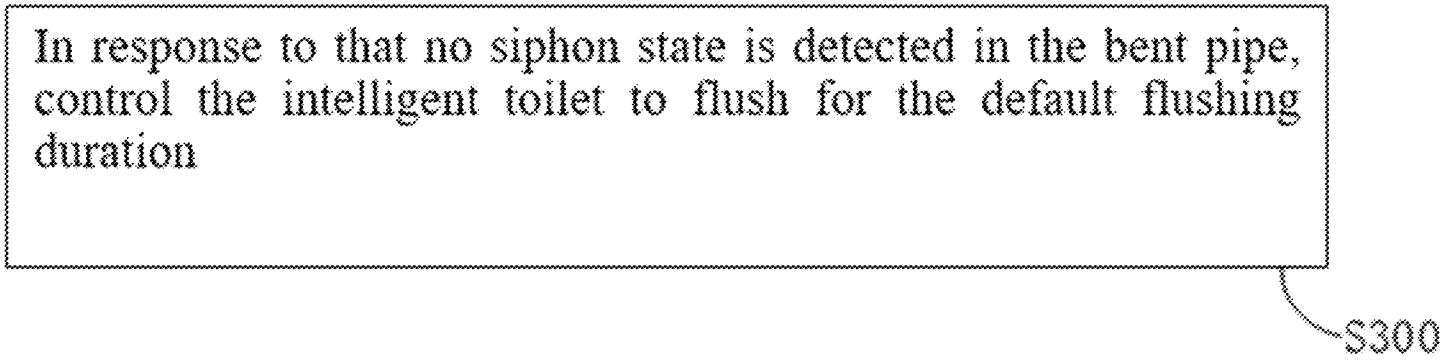
FIG. 4 illustrates a flow chart of another flushing control method of the intelligent toilet, according to some embodiments.

Referring to FIG. 4, in some embodiments, after step S100, the control method also includes:

S300: in response to that no siphon state is detected in the bent pipe 11, control the intelligent toilet 10 to flush for the default flushing duration.

When the siphon detection mechanism 20 detects no siphon state formed in the bent pipe 11, it indicates that the bent pipe 11 may be blocked, resulting in failure of formation of a siphon state in the bent pipe 11 and failure of normal discharge. The microcontroller 30 controls the intelligent toilet 10 to flush in accordance with default flushing duration, ensuring the intelligent toilet 10 can maintain a maximum flushing force and increase the water volume in the bent pipe 11, which could facilitate the formation of the siphon state in the bent pipe 11 to discharge the feculence under the siphon action.

Figure 5:
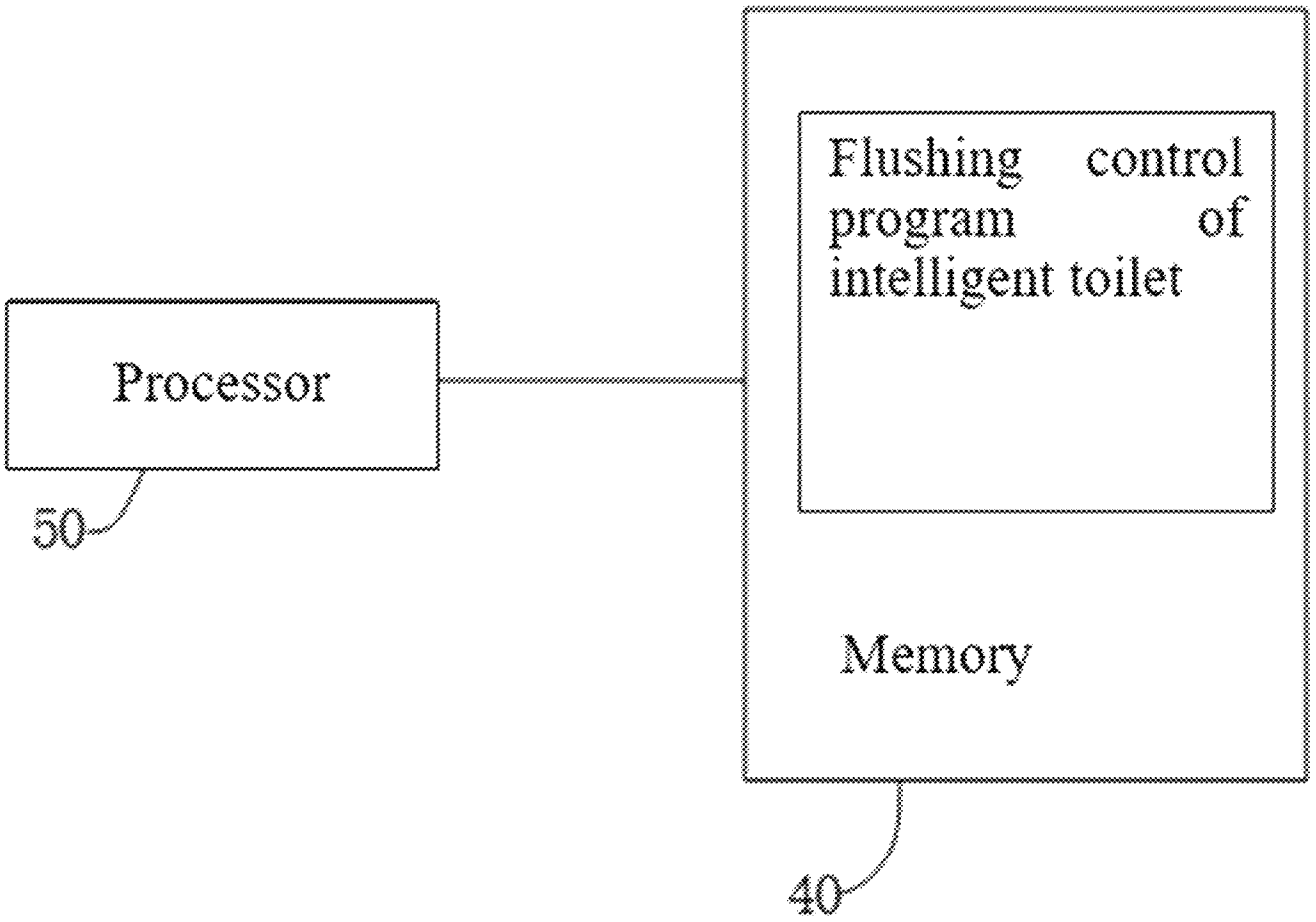
FIG. 5 illustrates a module schematic diagram of an electronic device, according to some embodiments.

Referring to FIG. 5, in some embodiments, an electronic device includes a memory 40 and a processor 50. The memory stores the flushing control program for the intelligent toilet 10, and the processor 50 is connected to the electrical signal of the memory 40. When the flushing control program of the intelligent toilet 10 is executed by the processor 50, the processor 50 executes any flushing control method of the intelligent toilet 10 in the above embodiments.

In this embodiment, the electronic device includes a memory 40 and a processor 50 coupled to each other. The memory 40 stores the program instructions for detection methods and the processor 50 executes the program instructions which are stored in the memory 40 so as to realize the steps of any of above flushing control methods of the intelligent toilet 10. In a specific embodiment, the electronic device may include but not limited to a microcomputer, a server, etc. In some embodiments, the processor 50 can control itself and the memory 40 so as to realize the steps of any of above implementation methods. The processor 50 also may be called Central Processing Unit (CPU). The processor 50 may be an integrated circuit chip with signal processing capabilities. The processor 50 may also be a general-purpose processor 50, a Digital Signal Processor (DSP) 50, an Application Specific Integrated Circuit (ASIC), a Field-Programmable Gate Array (FPGA) or other programmable logic devices, discrete gate or transistor logic devices, and discrete hardware components. The general-purpose processor may be a microprocessor or a conventional processor. In addition, the processor 50 may be jointly realized by an integrated circuit chip.

The above content is only the embodiments in this disclosure and constitutes no limitation to the scope of the patent in this disclosure. Any equivalent structure or equivalent process transformation made by reference of the specification and accompanying drawings in this disclosure, or direct or indirect disclosure in other related technical fields are included in the protection scope of this disclosure.

What is claimed is:

1. An intelligent toilet, comprising a bent pipe and a flushing control mechanism, wherein the intelligent toilet further comprises:

a siphon detection mechanism, in response to a start of the flushing control mechanism, detecting whether a siphon state is formed in the bent pipe; and a microcontroller, connected with the siphon detection mechanism and a flushing control mechanism, and, in response to the siphon detection mechanism detecting a siphon state formed in the bent pipe, controlling the flushing control mechanism to stop; wherein, a total operation duration of the flushing control mechanism is shorter than or equal to a default flushing duration of the intelligent toilet.

2. The intelligent toilet according to claim 1, wherein the siphon detection mechanism acquires a first time when the siphon state is formed in the bent pipe, a difference between the first time and the start time of the flushing control mechanism is a first difference which is positively correlated with a total operation duration of the flushing control mechanism.

3. The intelligent toilet according to claim 2, wherein, in response to that the first difference is within a first preset threshold, the microcontroller also controls the flushing control mechanism to stop when the siphon detection mechanism detects that the siphon state is formed in the bent pipe for a first duration.

4. The intelligent toilet according to claim 3, wherein, in response to that the first difference is within a second preset threshold, the microcontroller also controls the flushing control mechanism to stop when the siphon detection mechanism detects that the siphon state is formed in the bent pipe for a second duration; wherein, the second preset threshold is larger than the first preset threshold and the second duration is longer than the first duration.

5. The intelligent toilet according to claim 4, wherein, in response to that the first difference is within a third preset threshold, the microcontroller also controls the flushing control mechanism to stop when the siphon detection mechanism detects that the siphon state is formed in the bent pipe for a third duration; wherein, the third preset threshold is larger than the second preset threshold and the third duration is longer than the second duration; and in response to that the total operation duration of the flushing control mechanism is longer than or equal to the default flushing duration, the microcontroller also controls the intelligent toilet to flush in accordance with the default flushing duration.

6. The intelligent toilet according to claim 1, wherein, in response to the siphon detection mechanism not detecting the formation of the siphon state in the bent pipe, the microcontroller also controls the intelligent toilet to flush in accordance with the default flushing duration.

7. The intelligent toilet according to claim 1, wherein the siphon detection mechanism comprises:

a water level detection assembly, provided in the bent pipe and connected to the microcontroller for detecting a water level in the bent pipe.

8. The intelligent toilet according to claim 7, wherein the water level detection assembly comprises at least one of a capacitive water level sensor or an ultrasonic water level sensor.

9. The intelligent toilet according to claim 7, wherein the bent pipe comprises:

a first pipe section, and a second pipe section, wherein the first pipe section and the second pipe section have a first end proximate to a bottom wall of the intelligent toilet and a second end away from the bottom wall of the intelligent toilet; the first end of the first pipe section is connected to a cavity of the intelligent toilet, the second end of the first pipe section is connected to the second end of the second pipe section, and the first end of the first pipe section is higher than the first end of the second pipe section;

wherein the first pipe section is provided with the water level detection assembly proximate to the second pipe section; or the second pipe section is provided with the water level detection assembly proximate to the first pipe section.

10. A flushing control method of an intelligent toilet, wherein the intelligent toilet comprises a bent pipe and a flushing control mechanism, and the control method comprises the following steps:

in response to a start of the flushing control mechanism, detect whether a siphon state is formed in the bent pipe; and in response to detecting the siphon state formed in the bent pipe, controlling the flushing control mechanism to stop; wherein, a total operation duration of the flushing control mechanism is shorter than or equal to a default flushing duration of the intelligent toilet.

11. The flushing control method according to claim 10, wherein the step of in response to detecting the siphon state formed in the bent pipe, controlling the flushing control mechanism to stop further comprises:

acquiring a first time when the siphon state is formed in the bent pipe and a first difference representing a difference between the first time and the start time of the flushing control mechanism, wherein the first difference is positively correlated with a total operation duration of the flushing control mechanism.

12. The flushing control method according to claim 11, wherein the step of acquiring the first time when the siphon state is formed in the bent pipe and the first difference representing the difference between the first time and the start time of the flushing control mechanism further comprises:

in response to that the first difference is within a first preset threshold and the siphon state formed in the bent pipe reaches a first duration, controlling the flushing control mechanism to stop.

13. The flushing control method according to claim 12, wherein the step of acquiring the first time when the siphon state is formed in the bent pipe and the first difference representing the difference between the first time and the start time of the flushing control mechanism further comprises:

in response to that the first difference is within a second preset threshold and the siphon state formed in the bent pipe reaches a second duration, controlling the flushing control mechanism to stop;

wherein, the second preset threshold is larger than the first preset threshold and the second duration is longer than the first duration.

14. The flushing control method according to claim 13, wherein the step of acquiring the first time when the siphon state is formed in the bent pipe and the first difference representing the difference between the first time and the start time of the flushing control mechanism further comprises:

in response to that the first difference is within a third preset threshold and the siphon state formed in the bent pipe reaches a third duration, controlling the flushing control mechanism to stop, wherein the third preset threshold is larger than the second preset threshold and the third duration is longer than the second duration; or in response to that the third duration is longer than or equal to the default flushing duration, controlling the intelligent toilet to flush in accordance with the default flushing duration.

15. The flushing control method according to claim 10, wherein the flushing control method further comprises:

in response to that no siphon state is detected in the bent pipe, controlling the intelligent toilet to flush in accordance with the default flushing duration.

16. An electronic device, comprising:

a memory, storing a flushing control program of an intelligent toilet; and a processor, electrically connected to the memory, wherein, when the flushing control program of the intelligent toilet is executed by the processor, the processor executes the flushing control method of the intelligent toilet of claim 10.

* * * * *